US005778990A

United States Patent [19]

Niemi

[11] Patent Number: 5,778,990

[45] Date of Patent: Jul. 14, 1998

[54] ARRANGEMENT IN A HYDRAULICALLY OPERATED ROCK DRILLING EQUIPMENT

[75] Inventor: Jaakko Niemi, Tampere, Finland

[73] Assignee: Tamrock Oy, Finland

[21] Appl. No.: 718,511

[22] PCT Filed: Apr. 4, 1995

[86] PCT No.: PCT/FI95/00183

§ 371 Date: Oct. 4, 1996

§ 102(e) Date: Oct. 4, 1996

[87] PCT Pub. No.: WO95/28549

PCT Pub. Date: Oct. 26, 1995

[30] Foreign Application Priority Data

Apr. 14, 1994 [FI] Finland ..... 941731

[51] Int. Cl.[6] ..... E21B 44/00

[52] U.S. Cl. ..... 175/27; 173/8; 173/11; 175/122

[58] Field of Search ..... 175/27, 122; 173/11, 173/8, 7

[56] References Cited

U.S. PATENT DOCUMENTS

| | | | |
|---|---|---|---|
| 3,979,944 | 9/1976 | Salmi et al. | 173/8 |
| 4,246,973 | 1/1981 | Mayer | 173/11 |
| 4,440,236 | 4/1984 | Shiihara et al. | 173/8 |
| 4,711,090 | 12/1987 | Hartiala et al. | 173/8 X |
| 4,793,421 | 12/1988 | Jasinski | 175/27 |
| 5,121,802 | 6/1992 | Rajala et al. | 173/1 |
| 5,458,207 | 10/1995 | Mattero | 175/27 |

FOREIGN PATENT DOCUMENTS

WO 94/24415 A1 10/1994 WIPO .

*Primary Examiner*—Hoang C. Dang
*Attorney, Agent, or Firm*—Nixon & Vanderhye P.C.

[57] ABSTRACT

Arrangement in a hydraulically operated rock drilling equipment comprising a feed motor (3), a percussion device (2), and a hydraulic pump (1) for feeding hydraulic fluid to the feed motor (3) and the percussion device (2). The arrangement comprises a pressure control valve (17) connected to be controlled on the basis of the control signal of the feed regulation valve (8) when starting the drilling so that when the value of the control signal is below a predetermined switching value, the pressure relief valve (18) is connected to the percussion pressure line (13) of the percussion device (2), and when the control signal exceeds the switching value, the pressure control valve (17) disconnects the pressure relief valve (18) from the percussion pressure line (13) and connects the pressure difference valve (20) in communication with the percussion pressure line (13).

9 Claims, 4 Drawing Sheets

ARRANGEMENT IN A HYDRAULICALLY OPERATED ROCK DRILLING EQUIPMENT

The invention relates to an arrangement in a hydraulically operated rock drilling equipment, comprising a rock drill provided with a percussion device; a feed motor for feeding the rock drill in the drilling direction and back, respectively; a hydraulic pump; a percussion pressure line and a feed pressure line both connected to the pump for feeding hydraulic fluid to the percussion device and the feed motor, respectively; a return line from the percussion device and the feed motor for returning hydraulic fluid to a tank for hydraulic fluid; a feed regulation valve and a feed regulator for regulating the flow of hydraulic fluid to the feed motor, the feed regulation valve being a signal-controlled proportional valve and the feed regulator being connected to control the feed regulation valve by means of at least one feed regulation line.

In rock drilling, collaring a hole has to be performed by using set values lower than the normal set values used in drilling, such as percussion pressure and feed, until the hole formed in the surface of the rock is deep enough to ensure that the drill bit stays in the hole. This has usually been done in such a way that the driller adjusts set values for collaring manually and then turns the controls to their maximum position.

U.S. Pat. No. 4,074,771 discloses a solution where the feed pressure of the feed machinery is adjusted by means of a control lever operated by the driller. In this patent the percussion operation of the percussion machinery is arranged to be controlled by the pressure of the hydraulic fluid of the feed motor in such a way that when the pressure exceeds a predetermined lower limit, the feed of hydraulic fluid into the percussion machinery increases with increasing feed pressure. Correspondingly, the flow of hydraulic fluid into the percussion machinery decreases with decreasing feed pressure. Accordingly, the percussion power can be adjusted at the same time as the pressure of the feed machinery is adjusted by means of a control valve connected to the control lever. It is also known from the patent that normal drilling is switched on after collaring by pushing the control lever for feed pressure to its extreme position, whereby both the feed and the percussion will be set at maximum power. In this situation, the rotation and percussion machineries are connected to follow the pressure of the feed machinery in such a way that when the feed pressure decreases, the rotation power and the power of the percussion machinery also decrease.

The solution disclosed in the U.S. patent is very complicated and difficult to realize, in addition to which its use in drilling is not optimal from the driller's point of view. The simultaneous adjustment of the feed pressure and the power of the percussion machinery and the rotation motor causes problems and makes collaring more difficult.

The object of the present invention is to provide an arrangement for controlling a rock drilling equipment, which allows the driller to control the collaring easily and efficiently while also allowing efficient normal drilling. The arrangement according to the invention is characterized in that the arrangement further comprises a first pressure relief valve having a lower preset pressure value than the highest allowable operating pressure of the percussion device; a pressure difference valve in communication with the feed pressure line; and a signal-controlled control valve connected between the percussion pressure line and the first pressure relief valve on one hand and the pressure difference valve on the other hand and being controlled by the feed regulation line controlling the forward operation of the feed motor in such a way that when the value of the control signal of said feed regulation line is below a predetermined switching value, the first pressure relief valve is switched in communication with the percussion pressure line through the control valve and keeps the pressure of hydraulic fluid applied to the percussion device at said preset pressure value, and when the value of the control signal of the feed regulation line exceeds said switching value, the control valve changes its position and connects the pressure difference valve in communication with the percussion pressure line in place of the first pressure relief valve, the pressure difference preset for the pressure difference valve prevailing between the percussion pressure line and the feed motor line.

An essential aspect of the invention is that the percussion power is set to a suitable predetermined level below the normal percussion power during collaring by setting the pressure of the hydraulic fluid supplied to the percussion device to a level below the pressure prevailing at full percussion power and adjusting solely the feed by means of a control connected to the control lever and having a control signal proportional to the turning angle of the control lever. The control regulates the flow amount of the hydraulic fluid of the feed motor in proportion to the control signal. In this way the driller is able to adjust the feed rate in a desired way during collaring. Another essential aspect of the invention is that when the value of the control signal exceeds a preset value, the pressure of the hydraulic fluid of the percussion device is increased to a normal percussion pressure. An essential feature of the preferred embodiment of the invention is that the difference between the pressures of the hydraulic fluids of the percussion device and the feed machinery is kept constant during normal drilling.

The invention will be described more fully with reference to the attached drawings, in which FIG. 1 is a general hydraulic diagram for the arrangement according to the invention;

Figure 1:
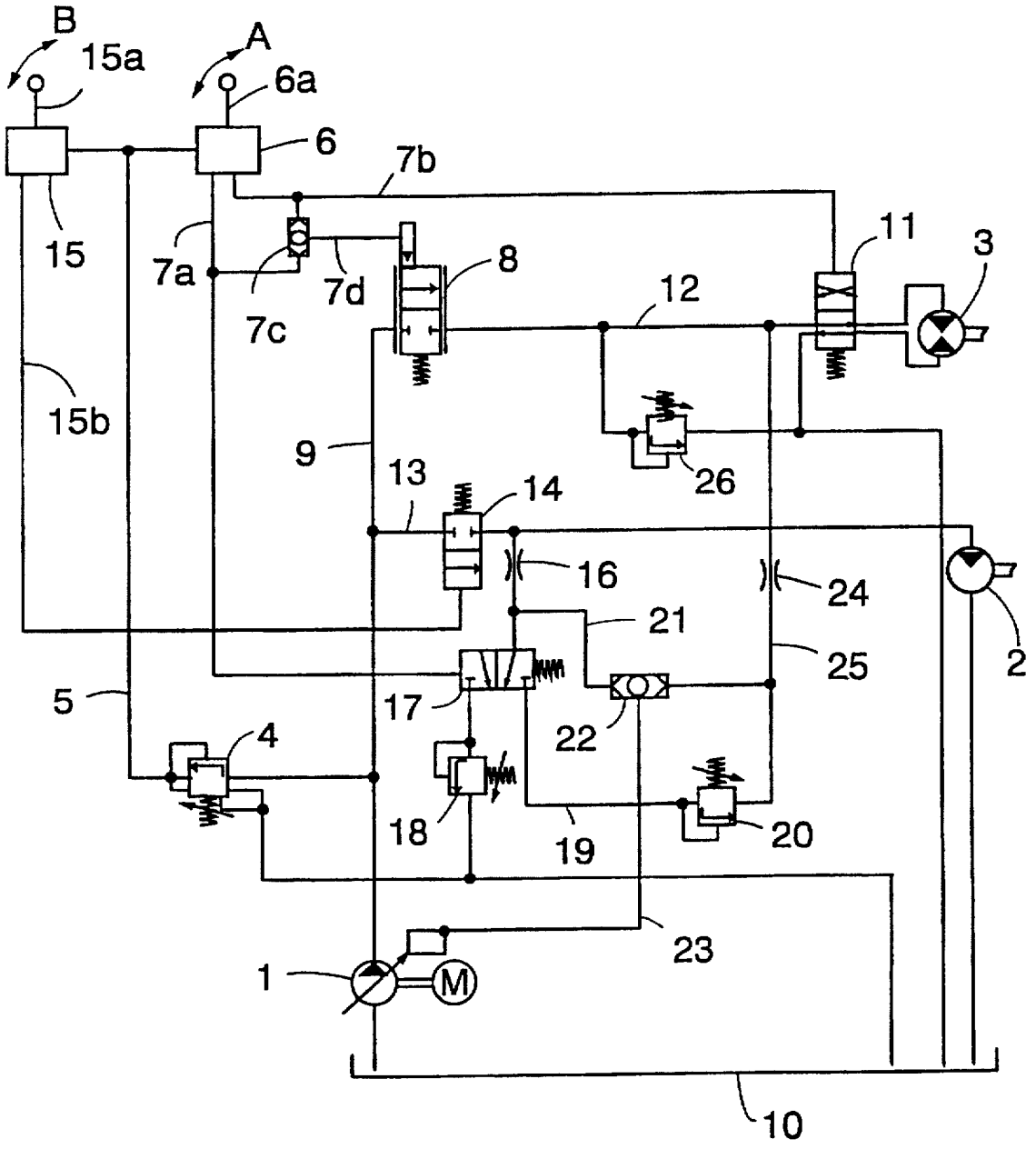

FIG. 1 shows a hydraulic diagram for a rock drilling equipment. The diagram comprises a hydraulic pump 1, preferably a pressure-controlled volume-flow pump, and a percussion device 2 connected to be operated by the pump, and a feed motor 3. The feed motor 3 may be either a hydraulic motor or hydraulic cylinder, depending on the application. In the present patent application and claims, the term feed motor is used generally to refer to both of them. In the drawings, the same numerals are used for similar parts, and they will be explained later in greater detail only if needed. To control the operation of the feed motor, a pressure reducing valve 4 is connected to a hydraulic line from the hydraulic pump 1 so as to reduce the pressure of the hydraulic fluid supplied by the hydraulic pump 1 to a level suitable for control valves. From the pressure reducing valve 4, a control pressure line 5 passes to a feed regulator 6, i.e. a feed regulation valve, which regulates the pressure of the flow of hydraulic fluid from the control pressure line 5 so as to adjust the flow of hydraulic fluid to the feed motor 3. The feed regulator 6 is a pressure regulation valve known per se, comprising a control lever 6*a*. The control lever 6*a* can be turned from its neutral position in two opposite directions, as shown by arrow A in the figure, so as to regulate the control pressure for the feed rate both when forwarding and retracting the drill rod. The feed regulator 6 has two associated feed regulation lines 7a and 7b, which are connected to a shuttle valve 7c. A line 7d from the shuttle valve 7c is further connected to a feed regulation valve 8. The feed regulation valve 8 is a pressure-controlled proportional valve, the flow of hydraulic fluid through the valve being proportional to a control pressure acting on it. The hydraulic pump 1 is connected to the feed regulation valve 8 by means of a feed pressure line 9. Both hydraulic lines of the feed motor 3 are connected to a directional control valve 11, which is connected to one of the feed regulation lines, i.e. the line 7b intended for regulating the return movement. From the directional control valve 11, a feed motor line 12 leads to the feed regulation valve 8 and one of the lines connected to the feed motor 3 through the directional control valve 11 leads to a tank 10 for hydraulic fluid so as to recycle the hydraulic fluid returning from the feed motor 3. Through the shuttle valve 7c the hydraulic fluid from the pressurized feed regulation line 7a or 7b is able to control the feed regulation valve 8. If the feed regulator 6 applies a pressure to the feed regulation line 7a, it controls the feed regulation valve 8 in proportion to the pressure value, and the shuttle valve 11 remains in the position shown in the figure. If the direction of movement of the feed motor is to be reversed, the feed regulator 6 applies a pressure to the feed regulation line 7b, whereby it will act on the feed regulation valve 8 through the shuttle valve 7c and at the same time changes the position of the directional control valve 11 so that the lines of the feed motor 3 cross each other, as a result of which the direction of movement is reversed. Depending on which one of the feed regulation lines 7a and 7b the feed control pressure is applied by means of the feed regulator 6, the feed motor 3 operates either forwards in the feed direction or in the reverse direction so that the amount of hydraulic fluid to the feed motor 3 and that from the feed motor are proportional to the control pressure.

From the hydraulic pump 1, a percussion pressure line 13 passes through a percussion valve 14 to the percussion device 2; from the percussion device 2 a return line for hydraulic fluid passes to the tank 10 for hydraulic fluid. The percussion valve 14 can be switched by means of a percussion control valve 15 connected to the control pressure line 5, i.e. by turning its control lever 15a in the direction of arrow B, from its rest position shown in the figure to a position where the hydraulic fluid from the hydraulic pump 1 flows through the percussion pressure line 13 to the percussion device 2 and further onwards.

To control the percussion pressure, a first throttle 16 is connected to the percussion pressure line 13. The throttle 16 in turn is connected through a pressure-controlled pressure control valve 17 on one hand to a first pressure relief valve 18 for adjusting the percussion pressure during collaring and on the other hand through a control line 19 alternatively to a pressure difference valve 20. A pressure indication line 21 connected between the throttle 16 and the pressure control valve 17 is further connected through a second shuttle valve 22 to a flow control line 23 for the hydraulic pump 1.

The feed motor line 12 of the feed motor 3 is connected through a second throttle 24 by means of a line 25 to the above-mentioned second shuttle valve 22, wherethrough it acts on the flow control line 23 of the hydraulic pump 1. The line 25 is further connected to the pressure difference valve 20 on the side opposite to its line 19. A feed pressure regulation valve 26 is further connected to the feed motor line 12, and it is connected on the other side in communication with the tank 10. The feed regulation line 7a controlling the forward feed is further connected to control the pressure control valve 17, whereby when the control pressure in the line 7a exceeds a predetermined limit value, the pressure control valve 17 changes its position.

The connection operates in the following way. On starting the drilling, the percussion control pressure is switched on by means of the percussion control valve 15, as a result of which the percussion valve 14 changes its position and admits the hydraulic fluid supplied by the hydraulic pump 1 through the percussion pressure line 13 to the percussion device 2. At the same time, hydraulic fluid flows in the percussion pressure line 13 through the first throttle 16 to the pressure control valve 17 and further to the first pressure relief valve 18, the set value of which can be adjusted and which can set a desired percussion pressure for collaring. Through the pressure indication line 21 connected between the throttle 16 and the pressure control valve 17, the pressure prevailing at this point is able to act through the second shuttle valve 22 on the flow control line 23 and thus to keep the output of hydraulic fluid from the hydraulic pump 1 on a level corresponding to the demand. At the same time, hydraulic fluid is able to enter the control pressure line 5 through the pressure reducing valve 4 to the feed regulator 6. When the control lever 6a of the feed regulator 6 is turned forwards in the feed direction, the pressure increases in the feed pressure line 7a, whereby the feed regulation valve 8 moves under the control of the pressure in the figure in a direction such that the hydraulic fluid starts to flow from the hydraulic pump 1 through the feed pressure line 9 via the feed regulation valve 8 and further through the feed motor line 12 to the feed motor 3. Correspondingly, hydraulic fluid flows from the feed motor 3 backwards and further through the directional control valve 11 to the tank 10. The feed pressure regulation valve 26 is able to set the feed pressure at which the feed motor 3 is to be operated. In order that the consumption of hydraulic fluid and the pressure level in the equipment would remain on a suitable level, the pressure of the feed motor acts through the line 25 via the second shuttle valve 22 on the hydraulic pump 1, and so it will limit the feed of hydraulic fluid from the hydraulic pump if the pressure increases excessively either in the percussion pressure line 13 of the percussion device or in the feed motor line 12 to the feed motor 3. The flow of hydraulic fluid to the feed motor 3 is regulated by the feed regulator 6 by turning its control lever 6a, whereby the flow of hydraulic fluid through the feed motor 3 increases with increasing turning angle. When the pressure of the hydraulic fluid in the feed regulation line 7a exceeds the switching pressure value of the pressure control valve 17, the pressure control valve 17 changes its position. The first pressure relief valve 18 is thereby switched off, and the throttle 16 is connected through the control line 19 to the pressure difference valve 20, which maintains a constant pressure difference between the percussion pressure line 13 of the percussion device 2 and the feed motor line 12 of the feed motor.

Figure 2:
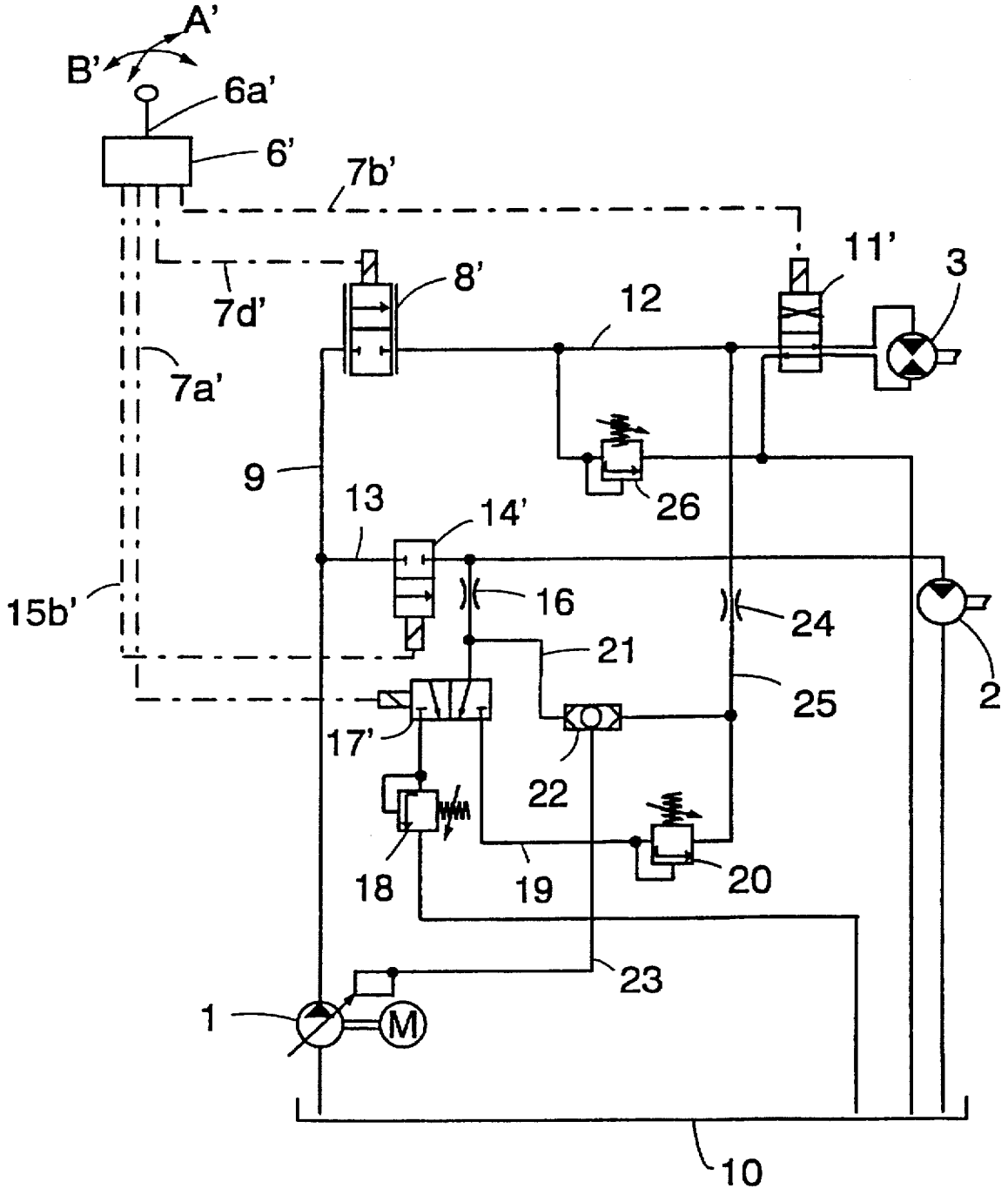
FIG. 2 is a general hydroelectric diagram for the arrangement according to the invention.

FIG. 2 shows a hydroelectric switching diagram corresponding to the diagram of FIG. 1. The feed regulator 6' is an electric control, i.e. a joystick, which is able to control two movements simultaneously along mutually crossing paths of movement shown with arrows A' and B' in the figure. Correspondingly, the directional control valve 11', the feed regulation valve 8', the percussion valve 14' and the pressure control valve 17' are electrically controllable. In this embodiment, an electric control signal applied to the feed regulation line 7a' controls the pressure control valve 17', and a separate control signal 7d' controls the feed regulation valve 8' in both the feed and the return direction.

When the control signal increases to a predetermined switching value, the pressure control valve 17' changes its position, and the switching arrangement operates otherwise hydraulically in the same way as in the switching diagram shown in FIG. 1. Correspondingly, when the feed motor 3 is controlled in the backward direction, the directional control valve 11' is switched to another position under the influence of a control signal applied to the feed regulation line *7b'*, as described in connection with FIG. 1.

Figure 3:
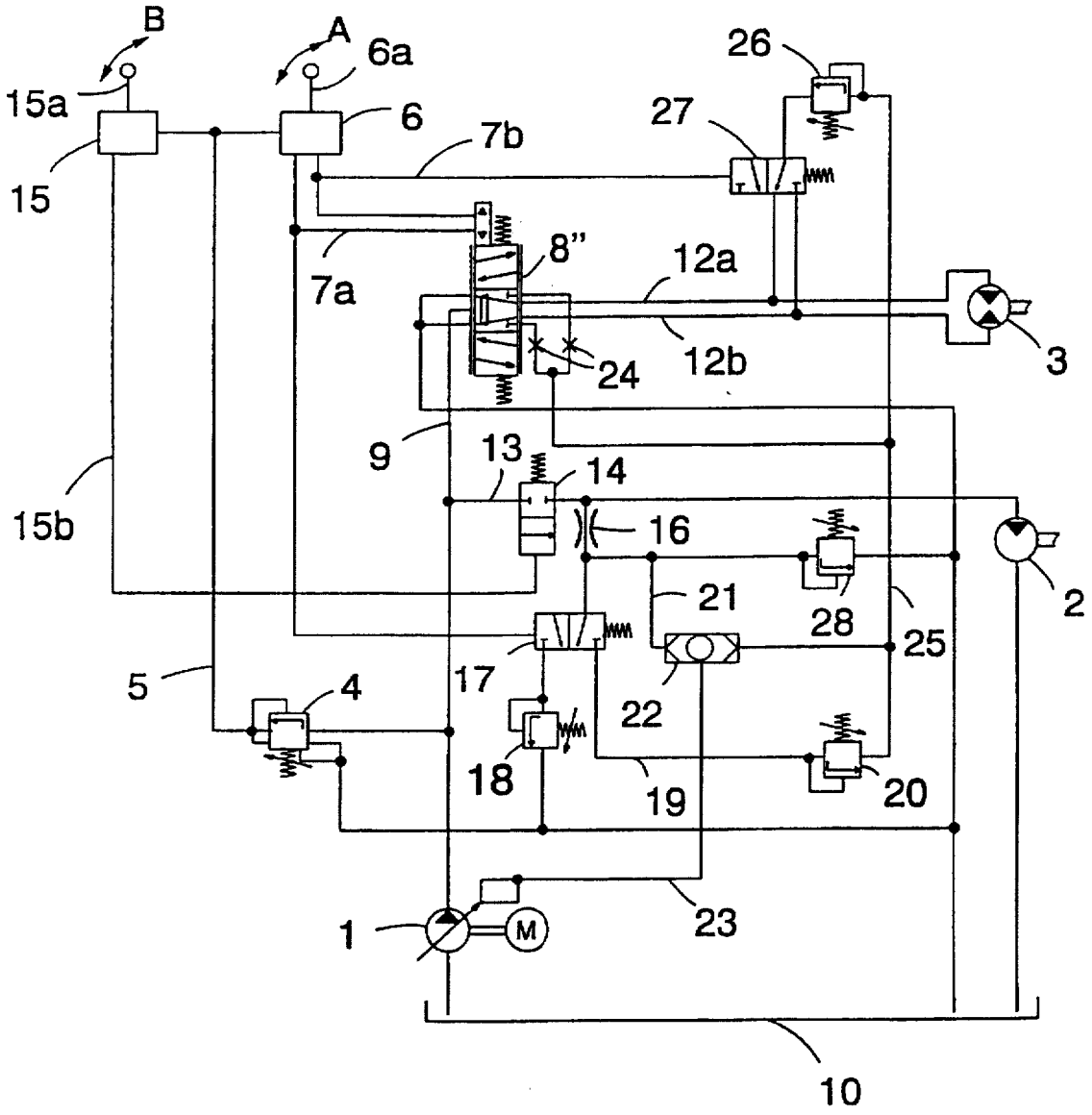
FIG. 3 is a more detailed hydraulic diagram for the arrangement according to the invention.

FIG. 3 illustrates a detailed embodiment of the invention, which mainly corresponds to the switching diagram shown in FIG. 1, but is shown more completely in some portions. In this embodiment, the feed regulation valve 8" is a two-way proportional valve, both of the feed regulation lines *7a* and *7b* being connected to control it. Correspondingly, both of the feed motor lines *12a* and *12b* of the feed motor are connected to the feed regulation valve 8", to which the feed pressure line is connected and from which a line passes to the tank 10. One line of the feed pressure regulation valve 26 is connected to the pressure-controlled control valve 27, which, depending on the feed direction, selects the so-called zero line for the feed pressure regulation valve, i.e. it selects that one of the feed motor lines *12a* and *12b*, in which hydraulic fluid returning from the feed motor 3 flows unpressurized to the tank 10 for hydraulic fluid. The pressure-controlled control valve 27 in turn is connected to the feed regulation line *7b* effecting the return movement. Consequently, when the rock drill is fed forwards, the control valve 27 remains in the position shown in the figure; correspondingly, when the rock drill is retracted, the control valve changes its position and at the same time switches the feed pressure regulation valve 26 in communication with the feed motor line *12a*. The figure also shows a second pressure relief valve 28, which is connected between the pressure indication line 21 and a line passing to the tank 10 for hydraulic fluid. In the situation shown in the figure, the pressure prevailing in the pressure indication line 21 is lower than the highest allowable operating pressure value of the percussion pressure set in the second pressure relief valve 28, and the valve 28 is not operative in this situation. Through the pressure indication lines from the feed regulation valve, the pressure of the hydraulic fluid prevailing in the feed motor line *12a* is able to act via the second throttle 24 on the feed pressure regulation valve 26, which in turn is connected to the other feed motor line *12b*. When the control pressure in the feed regulation line *7a* exceeds a preset limit value, the percussion pressure is able to rise. Correspondingly, the second pressure relief valve 28 is switched on, limiting the percussion pressure when it increases with the pressure of the feed motor so that the pressure will not exceed a preset maximum value, which the pressure prevailing in the percussion pressure line is not allowed to exceed for safety reasons. If there occurred nothing exceptional or no varying conditions, the percussion pressure would remain all the time in the value set by the second pressure relief valve 28, and the feed pressure of the feed motor 3 would be lower than the percussion pressure by the value determined by the pressure difference valve 20. In practice, the pressure of the feed motor varies, as the structure and hardness of the rock material to be drilled vary. When the feed pressure decreases for some reason as the feed proceeds more rapidly than usually, the machinery would be damaged if the percussion operation continued unchanged. If the feed pressure decreases suddenly for some reason, it may also cause the reference pressure of the pressure difference valve 20 to decrease so that it will correspondingly reduce the pressure of the percussion pressure line 13 of the percussion device so that the pressure difference remains constant even in this case. When the pressure in the feed motor line *12a* again rises, the pressure in the percussion pressure line of the percussion device rises correspondingly.

Figure 4:
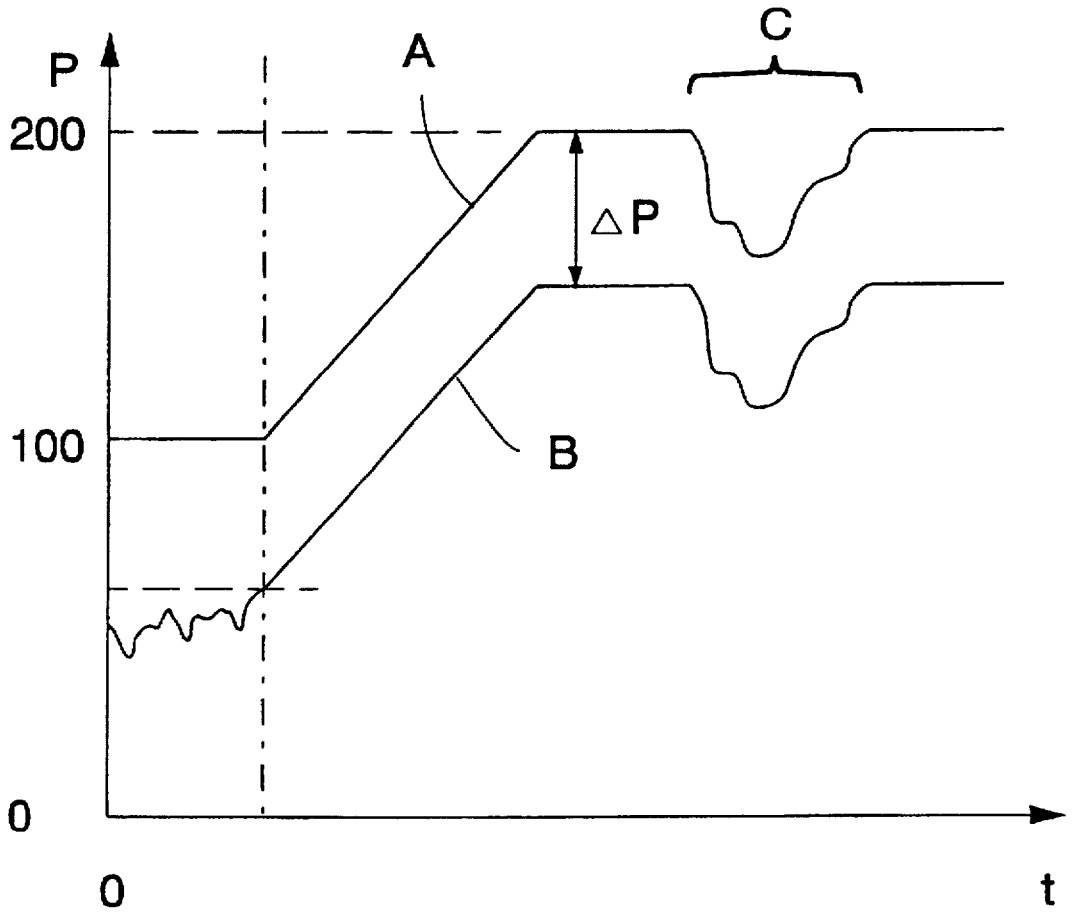
FIG. 4 is a diagram illustrating the pressures of the hydraulic fluid of the percussion machinery and the feed device relative to each other as a function of time.

FIG. 4 shows pressure curves for the percussion pressure and feed pressure by way of example as a function of time when the drilling is started with collaring and then continued with normal drilling. FIG. 4 shows a coordinate system, where the vertical axis represents the pressure and the horizontal axis the time. The upper curve A describes the percussion pressure, i.e. the pressure of hydraulic fluid in the percussion pressure line 13, and the lower curve B describes the feed pressure, i.e. the pressure of hydraulic fluid passing to the feed motor 3 in the feed motor line *12a*. When drilling is started at time 0, the percussion pressure has been set at a so-called half-operation value, e.g. 100 bar, at which value it remains throughout the collaring up to the termination of collaring indicated with the dashed line. The feed pressure in turn is lower than the percussion pressure; depending on the conditions, it may vary as long as the control pressure of the feed pressure line *7a* remains below a predetermined pressure value, i.e. the switching pressure of the pressure control valve 17. When the feed rate is increased, the pressure rises in the feed regulation line *7a*. When the collaring ends, the control lever *6a* is turned forwards to its extreme position, whereby the pressure of the feed regulation line *7a* exceeds the switching pressure of the pressure control valve 17. In this situation, the second pressure relief valve 28 and the pressure difference valve 20 are switched on, and the percussion pressure in the percussion pressure line 13 follows the feed pressure so that there is the constant pressure different $\Delta P$ between them. If the feed pressure falls below its highest value due to soft rock, a cavity or the like, as illustrated in the figure within area C, the percussion pressure correspondingly follows the feed pressure and rises back to the value determined by the second pressure relief valve 28 when the feed pressure again rises. When drilling is ended or when the drill rod is retracted for some other reason by pulling the control lever of the feed regulator 6 backwards, the pressure control valve 17 returns to the position shown in FIG. 1, and the pressure-controlled control valve 27 changes its position so that the feed pressure regulation valve 26 is switched between the feed motor lines *12a* and *12b* in the opposite direction, thus keeping the pressure at the feed motor 3 at a desired value.

The invention has been described above and shown in the attached drawings only by way of example and it is not in any way limited to this. In the switching diagram shown in FIG. 3, it is possible to utilize the so-called anti-jamming automatics in such a way that the pressure limiting effect of the valve 26 in the pressure lines of the feed motor 3 will be eliminated at the same time. This is necessary when the drill rod tends to get stuck, and it has to be possible to withdraw it with a force as high as possible. This solution can be realized simply by connecting a control valve to the regulation lines *7a* and *7b*, by means of which the lines can be connected mutually crosswise. In a jamming situation the feed pressure is thus switched by means of this control valve to control the feed regulation valve 8 in the opposite direction while the valve 27 remains in the position shown in the figure. In this way the valve 26 is connected on both sides to a pressurized line, wherefore it is not able to affect the pressure acting on the feed motor. Various pressure relief valves normally used for protection purposes and shut-off valves and control valves associated with the operation of the actuating means can be connected to the arrangement according to the invention in a manner known per se without affecting the invention and its operability. Similarly, the circuit of the feed motor can be connected in different ways to control the arrangement according to the invention. For instance, when the pressure of the rotation motor rises as the drill gets stuck or for some other similar reason, the feed direction of the feed motor can be reversed by a separate valve. The hydraulic connection of the arrangement thereby operates similarly as when the feed direction is reversed by means of the feed regulator 6.

I claim:

1. In hydraulically operated rock drilling equipment, an arrangement comprising a rock drill provided with a percussion device; a feed motor for feeding the rock drill in a drilling direction and in an opposite direction respectively; a hydraulic pump; a percussion pressure line and a feed pressure line, both connected to the pump for feeding hydraulic fluid to the percussion device and the feed motor respectively; a return line from the percussion device and the feed motor for returning hydraulic fluid to a tank for hydraulic fluid; a feed regulation valve and a feed regulator for regulating the flow of hydraulic fluid to the feed motor, the feed regulation valve being a signal-controlled proportional valve and the feed regulator being connected to control the feed regulation valve by means of at least one feed regulation line and wherein the arrangement further comprises a first pressure relief valve having a preset pressure value lower than the highest allowable operating pressure of the percussion device; a pressure difference valve in communication with the feed pressure line; and a signal-controlled control valve connected between the percussion pressure line and the first pressure relief valve on one hand, and the pressure difference valve on the other hand, and being controlled by the feed regulation line controlling the forward operation of the feed motor in such a way that when a control signal of said feed regulation line has a value below a predetermined switching value, the first pressure relief valve is switched in communication with the percussion pressure line through the control valve and keeps the pressure of hydraulic fluid applied to the percussion device at said preset pressure value, and when the value of the control signal of the feed regulation line exceeds said switching value, the control valve changes its position and connects the pressure difference valve in communication with the percussion pressure line in place of the first pressure relief valve, the pressure difference preset for the pressure difference valve prevailing between the percussion pressure line and a feed motor line.

2. The arrangement according to claim 1 further comprising a feed pressure regulation valve connected between the feed motor line supplying hydraulic fluid to the feed motor and an unpressurized hydraulic line passing to the tank for hydraulic fluid in such a way that it keeps the pressure of the hydraulic fluid applied to the feed motor at a value no higher than a limit value preset for the feed pressure regulation valve.

3. The arrangement according to claim 2 wherein the feed pressure regulation valve is an adjustable pressure-difference valve.

4. The arrangement according to claim 1 wherein the feed regulation valve is a two-directional proportional valve connected in communication with the feed motor by means of two feed motor lines, one of the feed motor lines being alternatively in communication with the feed pressure line so that pressurized hydraulic fluid flows through said one of the feed motor lines to the feed motor and returns through the other of the feed motor lines to the tank for hydraulic fluid.

5. The arrangement according to claim 4 wherein the feed pressure regulation valve is connected between the feed motor lines.

6. The arrangement according to claim 5 wherein the feed pressure regulation valve is connected to the feed motor lines on one hand through the feed regulation valve in such a way that it communicates with the feed motor line having a higher pressure and on the other hand through a pressure-controllable control valve connected to be controlled by the feed regulation line controlling the operation of the feed motor in such a way that when the rock drill is fed in the drilling direction, the control valve keeps the feed pressure regulation valve connected to that feed motor line which is in communication with the tank, and when the rock drill is fed in the opposite direction, the control valve connects the feed pressure regulation valve in communication with the feed motor line being unpressurized under the movement in the opposite direction.

7. Arrangement according to claim 1 wherein a directional control valve is connected to one of the feed regulation lines between the feed regulator and the feed motor line; and a percussion valve is connected to percussion pressure line upstream of the percussion device; and wherein the feed regulator is a hydraulic pressure regulation valve, and the directional control valve, the feed regulation valve, the percussion valve and the control valve are hydraulically controllable.

8. Arrangement according to claim 1 wherein a directional control valve is connected to one of the feed regulation lines between the feed regulator and the feed motor line; and a percussion valve is connected to percussion pressure line upstream of the percussion device; and wherein the feed regulator is an electric control, and the direction control valve, the feed regulation valve, the percussion valve and the control valve are electrically controllable hydraulic valves.

9. Arrangement according to claim 1 wherein the hydraulic pump is a pressure-controllable volume flow pump, and the percussion pressure line and the feed pressure line, respectively, are connected through a shuttle valve in communication with a control line of the hydraulic pump in such a way that the higher one of the pressures prevailing in the lines is connected to control the supply of hydraulic fluid by the hydraulic pump.

* * * * *